US005839938A

United States Patent [19]

Manthei et al.

[11] Patent Number: 5,839,938

[45] Date of Patent: Nov. 24, 1998

[54] MODULAR-DESIGN TOY SYSTEM

[75] Inventors: Stefan Manthei, Fürth/Bay; Werner Schön, Obermichelbach, both of Germany

[73] Assignee: Geobra Brandstätter GmbH & Co KG, Zirndorf, Germany

[21] Appl. No.: 605,790

[22] Filed: Feb. 22, 1996

[30] Foreign Application Priority Data

Feb. 25, 1995 [DE] Germany ..... 195 06 701.0

[51] Int. Cl.[6] ..... A63H 33/10

[52] U.S. Cl. ..... 446/120; 446/102; 446/111

[58] Field of Search ..... 446/85, 102, 108, 446/111, 112, 113, 114, 115, 116, 120, 121, 122

[56] References Cited

U.S. PATENT DOCUMENTS

| | | | |
|---|---|---|---|
| 419,099 | 1/1890 | Arold | 446/121 |
| 2,885,822 | 5/1959 | Ononian | 446/121 |
| 3,419,970 | 1/1969 | Wanderman | 446/113 |
| 3,597,874 | 8/1971 | Ogsbury et al. | 446/120 |
| 3,659,376 | 5/1972 | Fischer | 446/113 |
| 4,037,978 | 7/1977 | Connelly | 446/120 |
| 4,176,793 | 12/1979 | Dideriksen | 446/121 |
| 4,608,799 | 9/1986 | Hasegawa | 446/112 |
| 5,022,885 | 6/1991 | Lyman | 446/120 |
| 5,067,848 | 11/1991 | Hiigli | 446/113 |
| 5,312,283 | 5/1994 | Lyman | 446/120 |
| 5,322,466 | 6/1994 | Bolli et al. | 446/121 |

FOREIGN PATENT DOCUMENTS

| | | | |
|---|---|---|---|
| 0 379 033 B1 | 7/1990 | European Pat. Off. . | |
| 1092418 | 4/1955 | France | 446/122 |
| 740659 | 7/1944 | Germany | 446/112 |
| 21 11 971 C3 | 3/1971 | Germany . | |
| 22 08 882 C3 | 2/1972 | Germany . | |
| 72 40 172 U1 | 1/1973 | Germany . | |
| 2646561 | 4/1978 | Germany | 446/102 |
| 400355 | 10/1933 | United Kingdom | 446/121 |

*Primary Examiner*—Robert A. Hafer
*Assistant Examiner*—Jeffrey D. Carlson
*Attorney, Agent, or Firm*—Browdy and Neimark

[57] ABSTRACT

In a modular-design toy system for preparing buildings, vehicle and landscape structures etc., comprising building elements of plastic material, which are releasably attachable to each other by snap-fastener connecting elements, provision is made, with a view to obtaining a true-to-nature appearance at a reasonable cost and durable and constant snap-fastening properties, for connecting elements having first snap-in elements on one side for the easily releasable attachment to corresponding first locking recesses on the building elements and having second snap-in devices on the other side for the hard-to-release attachment to corresponding second locking recesses of the building elements.

23 Claims, 4 Drawing Sheets

MODULAR-DESIGN TOY SYSTEM

BACKGROUND OF THE INVENTION

1. Field of the Invention

The invention relates to a modular-design toy system for preparing buildings, vehicle and landscape structures etc., comprising building elements of plastic material which are releasably attachable to each other by means of snap-fastener connecting elements.

2. Background Art

Modular-design toy systems of the generic type are known for instance from DE 21 11 971 C3, DE 22 08 882 C3 and DE 72 40 172 U1. The connecting elements of the known toy systems are symmetrically structured, i.e. on their two sides by which to engage, they have correspondingly designed snap-in elements, the corresponding toy building elements having locking recesses that are designed to uniformly cooperate with the snap-in projections of the connecting elements.

Further toy systems are known, which can do without special connecting elements, snap-in projections being disposed on one side of the building elements and corresponding locking recesses on the other side, the arrangement of the snap-in projections and the locking recesses being as a rule of modular design.

European patent 0 379 033 discloses slip-on connections for toy building elements, modular-design grooves being formed on plate-type pieces, on to which grooves to slip the corresponding recesses of building elements to be fastened to the plates.

SUMMARY OF THE INVENTION

It is the object of the invention to embody a modular-design toy system by which to realize large-surface building elements of smooth continuous surfaces that will give a true-to-nature impression, the idea consisting in that it is possible to manufacture these building elements at a reasonable cost and to produce such a firm snap-engagement of durable and constant snap-fastening properties that buildings of some size can be realized, which are sufficiently stable for a child to play with, using for instance toy figures.

According to the invention, this object is attained in that connecting elements are provided, having first snap-in elements on one side for the easily releasable attachment to corresponding first locking recesses on the building elements, and having second snap-in devices on the other side for the hard-to-release attachment to corresponding second locking recesses of the building elements.

Owing to the concept according to the invention, the manufacture of the actual building elements is separated from the manufacture of the connecting elements. Only when starting to use such a toy system, a child will fix connecting elements to the building elements by hard-to-release snap-engagement wherever such connecting elements are needed to comply with a child's idea of playing, i.e. the child is free to leave certain sides or faces of building elements smooth by not providing them with connecting elements. The production of the hard-to-release snap-engagement will incite to playing, because the child virtually has to prepare and activate its toy system. When the building elements thus prepared are played with and a building or the like is to be modified, there will be no problem due to the second easily releasable attachments, it being ensured that only the easily releasable snap-attachments will be interrupted, while the connecting elements inserted in the building elements remain in place.

Consequently, it is possible by this building technique to realize comparatively large, smooth-surface building elements, for instance in the form of wall or bottom plates, and to attach them to each other durably and reliably.

In keeping with another embodiment of the invention, it can be provided that the second snap-in devices of the connecting elements can be inserted in the second locking recesses of the building elements in such a way that only the first snap-in elements project outwards over the respective surface, exhibiting the second locking recess, of the building element. This means that the connecting elements lodge in the respective building element, having positive fit, and with only the first snap-in elements projecting outwards.

Favorably, these first snap-in elements are in the form of a pin, in particular in the form of a pin slit crosswise.

In keeping with another advantageous embodiment, it is provided that the first snap-in elements are formed on a rectangular basic body and that the slits run in the direction of the diagonals of the rectangular basic body.

In the vicinity of the outer ends of the pin-type snap-in elements, provision is favorably made for snap-in projections which extend approximately in a direction perpendicular to the axial direction of the pin-type snap-in elements.

These snap-in projections may extend only over part of each sector of the crosswise slit pin-type snap-in elements, in particular in such a way that each of four snap-in projections extends on either side of the center of a rectangle side.

By advantage, the second snap-in devices are constituted by snap-in projections on the basic body of the connecting elements. Favorably, each basic body may have a rectangular and not a square basic shape, and the snap-in projections may be disposed on the lengthwise sides of the basic body. (i.e. the lateral edges 8 of the basic body 2).

This embodiment ensures that the snap-engagement is not released by rotation and, consequently, is hard to release. Releasing this snap-engagement is only possible by pulling in a direction perpendicular to the basic body of the connecting element. By contrast, the above-mentioned, easily detachable snap-engagement by the aid of the slitted pin ensures that two building elements thus attached to each other can be rotated one in relation to the other for them to be positioned or re-positioned one in relation to the other without the easily detachable snap-engagement having to be released.

In addition to the fact that the first snap-in elements are pins, this pivotability is also rendered possible by the fact that the first locking recesses are square and open preferably only towards the outside of the respective outer wall of the building member. At least two opposite sidewalls of the locking recess may have rear-recesses cooperating with the snap-in projections of the pin-type first snap-in elements.

By contrast, in order to provide the second locking recesses with a safeguard against rotation corresponding to the rectangular basic body of the connecting element, it can be provided that the second locking recesses likewise have a rectangular basic shape and that their lengthwise sides opposite to each other have rear-recesses cooperating with the snap-in projections of the second snap-in device.

As a rule, the properties of elasticity and durability of the connecting elements on the one hand and of the building elements on the other will differ, this being heeded by the use of different plastic materials, for instance ABS on the one hand and POM on the other. This is another important advantage of the separate manufacture of the connecting elements and of the building elements.

The building elements may be cuboidal, having side faces with and without locking recesses, locking recesses either of the first or of the second type being formed on different side faces. In particular, it is also possible to have surfaces that do not exhibit any snap-in elements at all.

A preferred embodiment provides for a building element to be of plate-type character with an edge extending downwards from the plane of the plate, studs being provided on the underside of the building elements within the edge, which are in alignment with the lower side of the edge and in which first locking recesses are provided. Correspondingly, such plates need not be solid, a certain "optical thickness" being achieved while saving material and weight.

Favorably, the recesses are formed alongside of the outer edges in parallel to the lines of the building elements, the distance of the locking recesses corresponding to the multiple of a modular dimension. Provision can also be made for two modular dimensions, a first modular dimension being realized within one building element and a second modular dimension being realized when two adjacent building elements rest on each other and the locking recesses thus neighboring have a second modular distance.

Within the scope of the invention, it is also conceivable that the locking recesses have an oblongly slitted, rectangular shape so that a building element and a connecting element can be arrested displaceably in the longitudinal direction of the slit.

Furthermore, connecting elements can be provided that have two easily detachable first snap-in elements, which serve to produce a connection between building elements with two corresponding locking recesses, for any turning or tilting moment to be straightened in this way.

Finally, there is the possibility to make the locking recesses round so that the members connected by the production of a snap-attachment can be pivoted freely in relation to each other. This embodiment can be provided whenever the relative angular orientation of two building members to be connected is of no importance or in special cases where pivotability is desired.

Provision is also made for a tool for mounting the connecting elements on the building elements, this tool being a bar, at least one end of which has a first locking recess for the production of an easily releasable snap-engagement. Correspondingly, it is possible, by means of such a tool, to lift a connecting element and to insert it with its second snap-in devices in a second locking recess, thus producing a hard-to-release attachment. After the positioning of the connecting element, the easily releasable snap-attachment of the tool to the connecting element can easily be separated.

Within the scope of the invention, it is also possible to provide a special tool, by means of which to release the connecting elements from the hard-to-release snap-attachments.

Details of the invention will become apparent from the ensuing description of a preferred embodiment, taken in conjunction with the drawing.

DESCRIPTION OF THE PREFERRED EMBODIMENT

Figure 1:
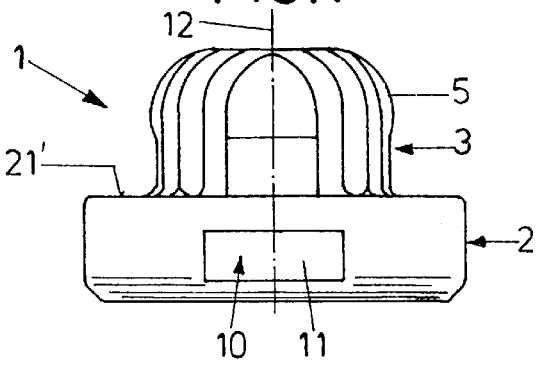
FIG. 1 is a perspective view of a connecting element according to the invention.
Figure 2:
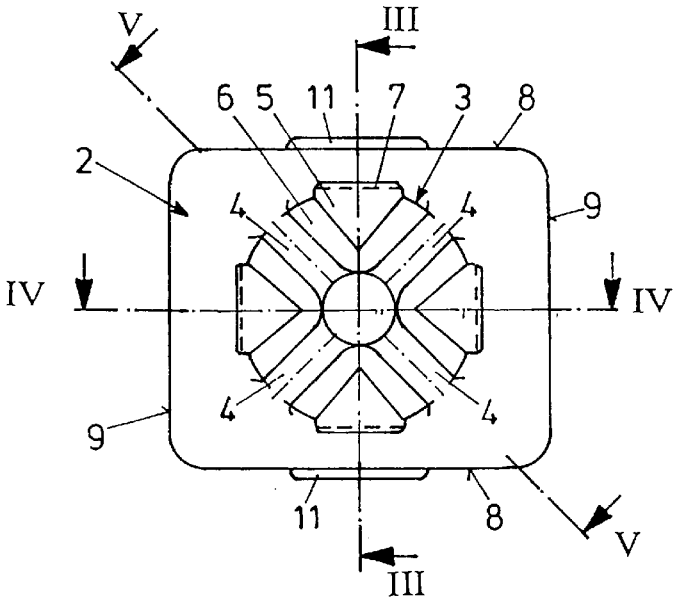
FIG. 2 is a plan view of a connecting element according to the invention.
Figure 3:
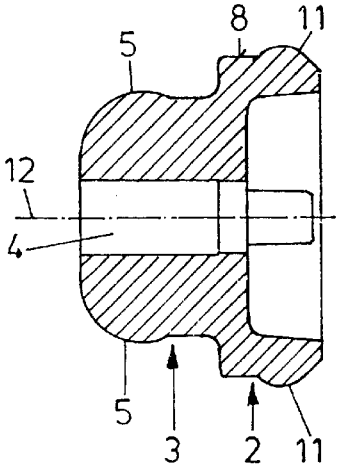
FIG. 3 is a section along the line A—A of FIG. 2.
Figure 5:
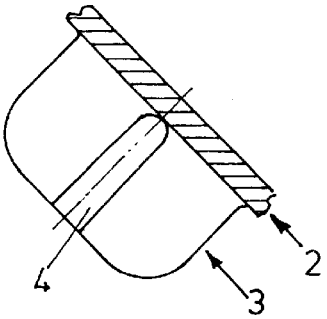
FIG. 5 is a section along the line C—C of FIG. 2.
Figure 4:
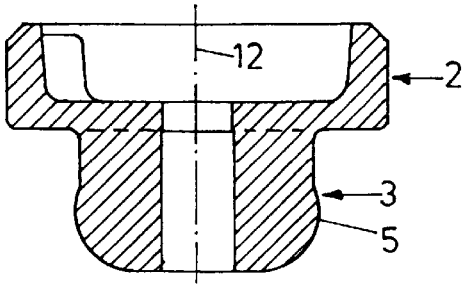
FIG. 4 is a section along the line B—B of FIG. 2.

FIG. 1 illustrates a connecting element 1 according to the invention, which has a rectangular basic body 2 seen in FIG. 2.

First snap-in elements 3 in the form of a pin project (upwards in FIG. 1) over one side of this basic body 2. The pin constituting the snap-in elements 3 is provided with crosswise slits 4 which run in the direction of the diagonals of the basic body 2 (cf. FIG. 2).

Snap-in projections 5 are formed on the outer ends of each sector 6 of the snap-in elements 3. As seen in particular in FIG. 2, the snap-in projections 5 only extend over part of each sector 6 of the pin-type snap-in elements 3, the outer edges 7 of the snap-in projections 5 running parallel to the lengthwise edges 8 and the crosswise edges 9 of the basic body 2.

Two snap-in devices 10 are formed on the other side of the basic body 2 (180 degrees opposed to the first snap-in element 3, as is apparent in FIG. 1) the lower side in FIG. 1, comprising two snap-in projections 11, which project outwards over the lengthwise sides 8 of the basic body, i.e. perpendicular to the longitudinal axis 12 of the pin-type snap-in elements 3.

Figure 6:
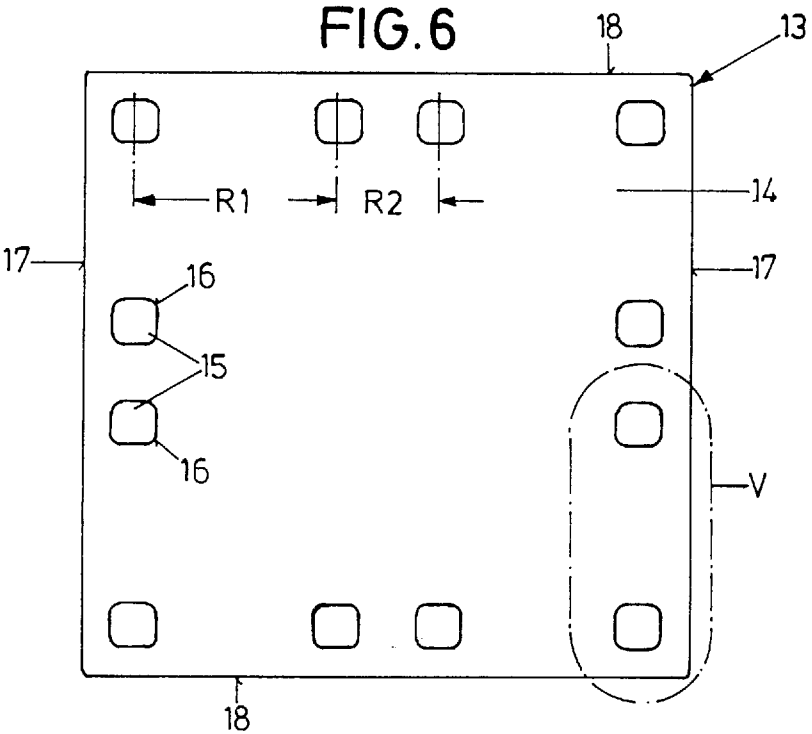
FIG. 6 is a plan view of a building element according to the invention.
Figure 7:
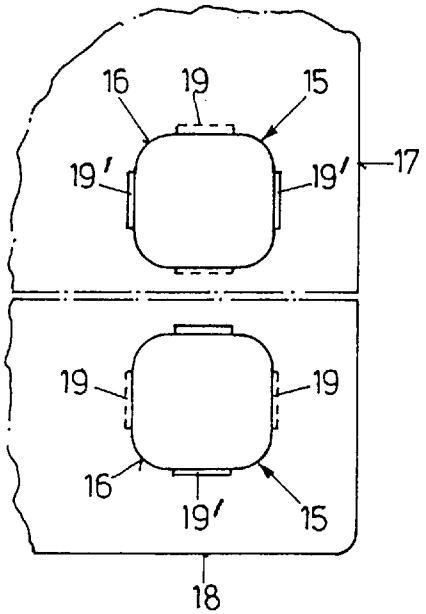
FIG. 7 is an illustration of the detail V of FIG. 6 on an enlarged scale.
Figure 12:
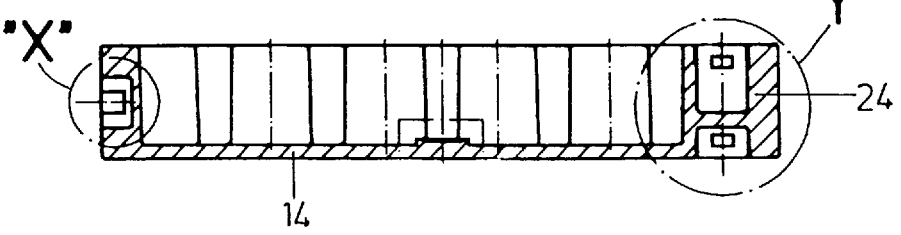
FIG. 12 is a section along the line A—A of FIG. 11.
Figure 11:
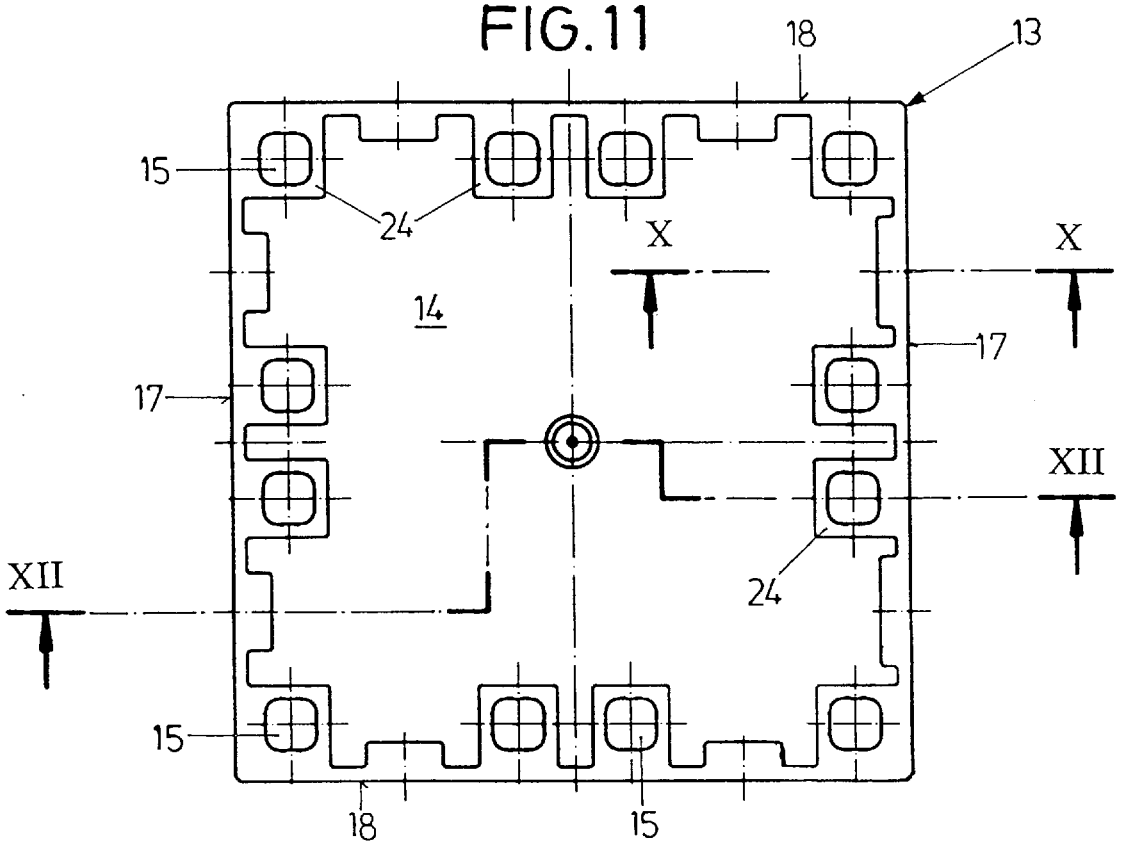
FIG. 11 is a view from below of the building element according to FIG. 6.
Figure 13:
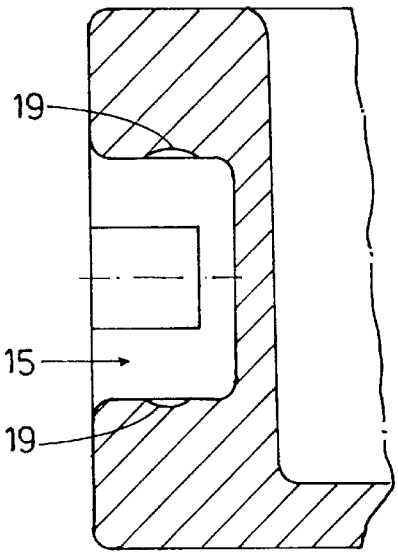
FIG. 13 is an illustration of the detail X of FIG. 12.

FIG. 6 illustrates a building element 13 in the form of a bottom plate, which has a plane basic body 14 and a continuous sidewall 17, 18 extended downwards.

Each building element 13 is provided with first locking recesses 15, which exhibit a square basic shape with rounded corners 16 and which are disposed parallel to the sidewalls 17, 18 at a first modular distance R1 and at a second modular distance R2, respectively.

Also the sidewalls are provided with such first locking recesses 15 on two sidewalls 18 opposite to each other.

On sides opposite to each other, each locking recess 15 has rear recesses or clearances 19, 19', which correspond in shape to the snap-in projections 5, rendering possible the releasable snapping-in of the snap-in projections 5. Owing to the pin-type design of the snap-in elements 3 and the rounded square design of the locking recesses 15, it is possible to rotate relative to each other the building elements 13 and connecting elements 1 in the condition of snap-engagement.

Figure 14:
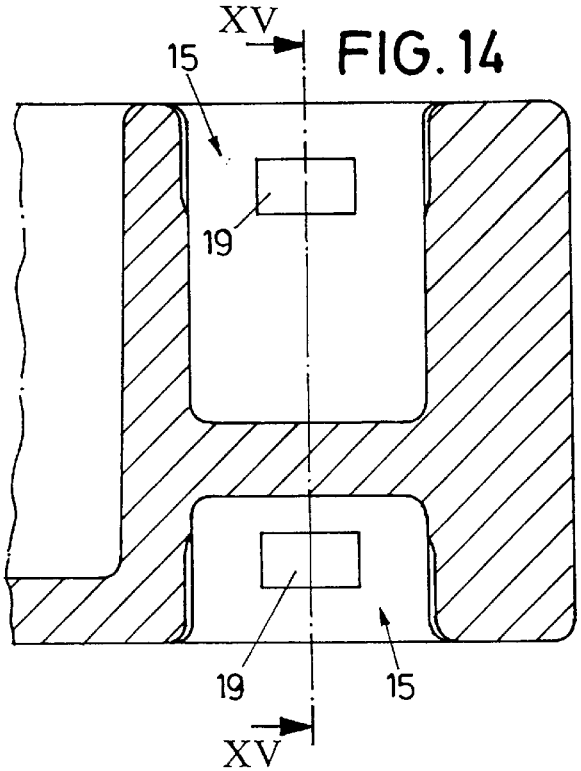
FIG. 14 is an illustration of the detail Y of FIG. 12.
Figure 15:
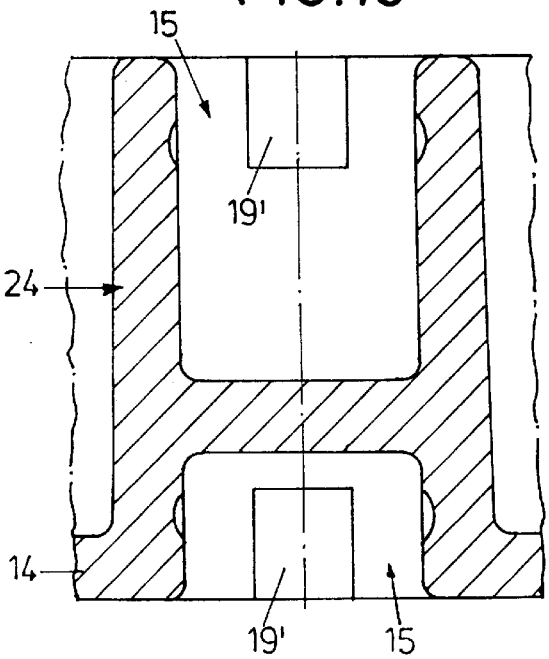
FIG. 15 is a section along the line C—C of FIG. 14, i.e. a section displaced by 90° as compared to the illustration of FIG. 14.

The design of the rear recesses 19, 19' of the first locking recesses 15 becomes apparent in particular from the comparison of FIGS. 14 and 15. This shows that the rear recesses 19 formed on two sides opposite to each other of each locking recess 15 extend only over a certain section in the axial direction, whereas the rear recesses 19' provided on the in each case other pair of opposite walls of the locking recesses 15 extend as far as to the upper edge of the locking recess 15.

Figure 10:
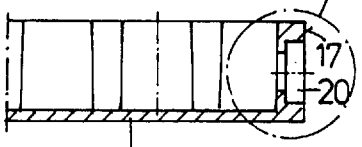
FIG. 10 is a section along the line B—B of FIG. 11.
Figure 9:
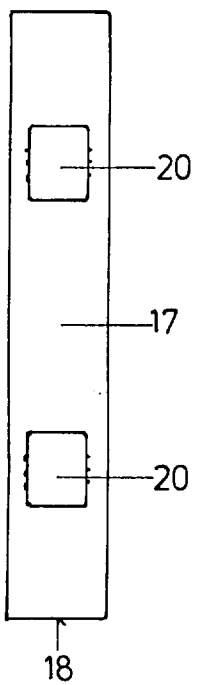
FIG. 9 is a lateral view of a second side, rotated by 90° referred to FIG. 8, of the building element.
Figure 8:
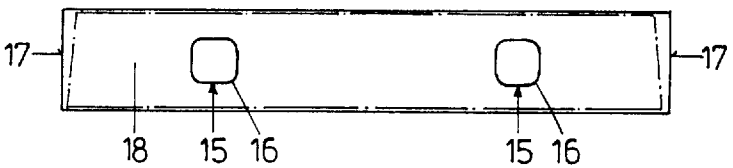
FIG. 8 is a lateral view from a first side of the building element according to FIG. 6.
Figure 16:
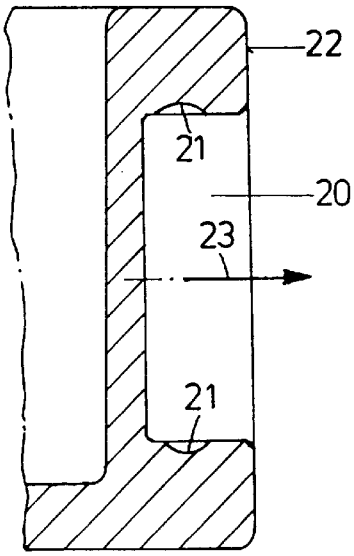
FIG. 16 is an illustration of the detail Z of FIG. 10.

Second locking recesses 20 of rectangular basic shape are formed on the sidewalls 17 that are perpendicular to the sidewalls 18. The structure of these locking recesses 20 becomes apparent in particular from the combination of FIGS. 9, 10 and 16. On two sides opposite to each other, the locking recesses 20 have rear recesses 21 which cooperate with the snap-in projections 11 on the basic body of the connecting elements 1. The basic shape and the depth of the locking recesses 20 corresponds to the basic shape and the height of the basic body 2 so that, upon insertion of the basic body 2 in the locking recesses 20, the upper side 21' of the basic body 2 is in alignment with the respective outer face, for instance the outer face 22 of the building element. Owing to the rectangular design of the locking recess 20 and the basic body 2, any snap-attachment thus produced cannot be released by rotation nor can it be loosened, i.e. the snap-attachment is firm and can only be released by comparatively high forces being applied precisely in the axial direction (arrow 23 of FIG. 16).

Although the plate 14 of the building element 13 is only comparatively thin, first locking recesses 15 can nevertheless be realized on the underside of the plane basic body 14 by studs 24 projecting over the underside of the plate 14, which virtually form a square wall, thus ensuring that locking recesses 15 can be provided.

What is claimed is:

1. A modular-design toy system comprising snap-fastener connecting elements and building elements of plastic material, which are releasably attachable to each other by the snap-fastener connecting elements, wherein each of the connecting elements (1) includes a basic body (2) having a generally polygonal shape with top and bottom sides and lateral edges first snap-in elements (3) in the form of slit pins on one side of the basic body for easily releasable attachment to corresponding first locking recesses (15) on the building elements (13), and second snap-in devices (10) formed by snap-in projections (11) on lateral edges of the basic body (2) of the connecting element, wherein the building elements include second locking recesses (20) having substantially the polygonal shape and, on two lengthwise sides opposite to each other, rear recesses (21) co-operating with the snap-in projections (11) of the second snap-in device.

2. A toy system according to claim 1, wherein the second snap-in devices (10) of the connecting elements (1) can be inserted in the second locking recesses (20) of the building elements (13) in such a way that only the first snap-in elements (3) project outwards over a surface including the second locking recess (20), of the building element (13).

3. A toy system according to claim 1, wherein the first snap-in elements (3) have the form of a crosswise slitted pin.

4. A toy system according to claim 3, wherein the first snap-in elements (3) are formed on a rectangular basic body (2) and wherein slits of the slit pins run in the direction of the diagonals of the rectangular basic body (2).

5. A toy system according to claim 4, wherein in the vicinity of outer ends of the pin-type snap-in elements (3), snap-in projections (5) are formed, which extend approximately in a direction perpendicular to an axial direction of the first pin-type snap-in elements (3).

6. A toy system according to claim 5, wherein the snap-in projections (5) only extend over partial sections (6) of the crosswise slitted, pin-type snap-in elements (3).

7. A toy system according to claim 6, wherein four of the snap-in projections (5) extend along contour lines of a rectangle basic body in such a way that each of the four snap-in projections (5) extends on either side of the center of a rectangle side.

8. A toy system according to claim 1, wherein the basic body (2) has a rectangular and not a square basic shape and wherein the snap-in projections (11) are disposed on the lengthwise sides of the basic body (2).

9. A toy system according to claim 1, wherein the first locking recesses (15) are approximately square.

10. A toy system according to claim 9, wherein the building element includes an outer wall, the first locking recesses (15) are open only towards the outside of said respective building element outer wall.

11. A toy system according to claim 10, wherein at least two opposite sidewalls of the first locking recess (15) have rear recesses (19, 19') that cooperate with the snap-in projections (5) of the pin-type first snap-in elements (3).

12. A toy system according to claim 1, wherein the building elements (13) and the connecting elements (1) consist of a different plastic material.

13. A toy system according to claim 12, wherein the building elements (13) are of ABS and the connecting elements (1) are of POM.

14. A toy system according to claim 1, wherein the building element (13) is cuboidal, having side faces without locking recesses and side faces with locking recesses.

15. A toy system according to claim 14, wherein at least one of the first locking recesses and the second locking recesses are formed on different side faces of the building element (13).

16. A toy system according to claim 1, wherein at least one of the first locking recesses and the second locking recesses (15, 20) are formed alongside outer edges of parallel lines of the building elements (13), a distance of the locking recesses (15, 20) corresponding to the multiple of a modular dimension (R1, R2).

17. A toy system according to claim 16, wherein two modular dimensions (R1 and R2) are provided.

18. A toy system according to claim 1, wherein at least one of the first locking recesses and the second locking recesses are of oblong slit-type rectangular shape.

19. A toy system according to claim 1, wherein at least one of the first locking recesses and the second locking recesses are round.

20. A toy system according to claim 1, wherein connecting elements having a releasable snap-in device on both sides are provided in addition.

21. A toy system according to claim 1, wherein the second snap-in devices in the second locking recesses form a hard-to-release attachment which is not releasable by rotation but is releasable only by puling in a direction perpendicular to the basic body.

22. A toy system according to claim 1, wherein the generally polygonal shape is rectangular.

23. A modular-design toy system for preparing buildings, vehicle and landscape structures etc., comprising building elements of plastic material, which are releasably attachable to each other by snap-fastener connecting elements, wherein connecting elements (1) are provided, having first snap-in elements (3) on one side for the easily releasable attachment to corresponding first locking recesses (15) on the building elements (13), and having second snap-in devices (10) on the other side for the hard-to-release attachment to corresponding second locking recesses (20) of the building elements;

wherein the building element (13) is cuboidal, having side faces without locking recesses and side faces with locking recesses;

wherein the building element (13) is plate-type in shape with sidewalls (17, 18) projecting downwards over the plane of the plate, studs (24) being provided on the underside of the building element (13) within the sidewalls (17, 18), which studs (24) are in alignment with a lower edge of the sidewalls (17, 18) and in which are formed first locking recesses (15).

* * * * *